US011371698B2

(12) United States Patent
Chen et al.

(10) Patent No.: US 11,371,698 B2
(45) Date of Patent: Jun. 28, 2022

(54) BURNER AND WATER HEATER

(71) Applicants: WUHU MIDEA KITCHEN AND BATH APPLIANCES MFG. CO., LTD., Wuhu (CN); MIDEA GROUP CO., LTD., Foshan (CN)

(72) Inventors: Wenfeng Chen, Wuhu (CN); Xianchao Meng, Wuhu (CN); Guorong Liang, Wuhu (CN)

( * ) Notice: Subject to any disclaimer, the term of this patent is extended or adjusted under 35 U.S.C. 154(b) by 58 days.

(21) Appl. No.: 17/055,126

(22) PCT Filed: Jun. 13, 2018

(86) PCT No.: PCT/CN2018/091096
§ 371 (c)(1),
(2) Date: Nov. 13, 2020

(87) PCT Pub. No.: WO2019/218413
PCT Pub. Date: Nov. 21, 2019

(65) Prior Publication Data

US 2021/0215336 A1 Jul. 15, 2021

(30) Foreign Application Priority Data

May 15, 2018 (CN) ..... 201810461505.6

(51) Int. Cl.
*F23D 14/78* (2006.01)
*F23D 14/64* (2006.01)
*F23K 5/06* (2006.01)

(52) U.S. Cl.
CPC ..... *F23D 14/78* (2013.01); *F23D 14/64* (2013.01); *F23D 2900/14041* (2013.01); *F23K 5/06* (2013.01)

(58) Field of Classification Search
CPC ..... F23D 14/78; F23D 14/586
(Continued)

(56) References Cited

U.S. PATENT DOCUMENTS 1,935,705 A * 11/1933 Fuller ..... F23D 14/586 431/346
5,379,750 A 1/1995 Larsen et al.

FOREIGN PATENT DOCUMENTS

CN 104566372 A 4/2015
CN 204901764 U 12/2015
(Continued)

OTHER PUBLICATIONS

Supplementary European search report of EP Application No. 18919331.1.

*Primary Examiner* — Vivek K Shirsat
(74) *Attorney, Agent, or Firm* — Kilpatrick Townsend & Stockton, LLP

(57) ABSTRACT

Provided are a burner and a water heater. The burner comprises multiple flame splitters, and each of the flame splitters is provided with at least three ejector pipes, and the multiple flame splitters are arranged parallel to one another; a fastener penetrates through the multiple flame splitters and connects the multiple flame splitters into a flame row; and compressing members are arranged at end parts where the fastener extends relative to the flame row, and the compressing members compress the flame row. The burner is integrally installed, easy to operate and firmly fixed, the combustion intensity can also be increased, the emission of nitrogen oxides is reduced, and the safety of use is ensured.

15 Claims, 5 Drawing Sheets

(58) Field of Classification Search
USPC ..... 126/110 R; 454/354
See application file for complete search history.

(56) References Cited

FOREIGN PATENT DOCUMENTS

| | | | |
|---|---|---|---|
| CN | 205026669 | U | 2/2016 |
| CN | 205037302 | U | 2/2016 |
| CN | 207065570 | U | 3/2018 |
| CN | 208269127 | | 12/2018 |
| EP | 3303921 | A1 | 4/2018 |

* cited by examiner

BURNER AND WATER HEATER

CROSS-REFERENCES TO RELATED APPLICATIONS

The present disclosure is a national phase application of International Application No. PCT/CN2018/091096, filed on Jun. 13, 2018, which claims priority to Chinese Patent Application No. 201810461505.6, filed with the China National Intellectual Property Administration (CNIPA) on May 15, 2018, the entireties of which are herein incorporated by reference.

FIELD

The present application relates to the field of household appliances, in particular a burner, and a water heater using such burner.

BACKGROUND

A burner is a general term for a device for ejecting, mixing, and burning fuel and air in a certain manner. At present, a burner is mostly used in household appliances such as a water heater or a wall-hanging furnace to provide domestic hot water or heat for residents at home.

However, the existing burner has the problems of being installed not securely enough, inadequate ejection, and insufficient combustion heat intensity, tending to generate a large amount of nitrogen oxides.

SUMMARY

The present application provides a burner, which comprises a plurality of flame distributors each provided with at least three ejection tubes and arranged in parallel with each other;

a fastener passing through the plurality of the flame distributors and connecting the plurality of the flame distributors into a fire grate; and a compacting piece provided at a protruding end of the fastener relative to the fire grate and compacting the fire grate.

In one embodiment, the fastener comprises at least one pair of fasteners, each pair of fasteners are symmetrically arranged relative to a symmetry axis of the flame distributor in a plumb direction.

In one embodiment, a first side plate is provided on either side of the fire grate, both ends of the fastener respectively pass through their corresponding first side plates, and the first side plates and the fire grate are compacted by the compacting piece.

In one embodiment, lower ends of the first side plates respectively bend towards outsides of the fire grates and extend horizontally, forming first side platforms.

In one embodiment, the burner further comprises a gas distribution device arranged below the ejection tubes;

a plurality of gas passages are provided in the gas distribution device and the gas passages are in communication with their corresponding ejection tubes;

a second side plate is provided on either side of the gas distribution device, and upper ends of the second side plate faces respectively bend towards outsides of the gas distribution device and extend horizontally, forming second side platforms;

the gas distribution device is securely connected to the fire grate at the first side platforms and the second side platforms.

In one embodiment, a front side plate is provided on a front side of the fire grate, an igniter is provided on an upper portion of the front side plate, and an ignition portion of the igniter is arranged towards a gas outlet end of the flame distributors.

In one embodiment, the ignition portion comprises a first ignition end and a second ignition end;

the first ignition end protrudes towards top of the front side plate, and bends and extends towards rear of the front side plate; and the second ignition end protrudes towards the top of the front side plate, and bends and extends towards the rear of the front side plate, with its extending tip bent towards the gas outlet end.

In one embodiment, the burner further comprises a cooling water pipe which is U-shaped;

the flame distributor is provided with at least two first through-holes, and both ends of the cooling water pipe respectively pass through corresponding first through-holes and throughout the fire grate; and the first through-holes are arranged between adjacent ejection tubes.

In one embodiment, a top plate is snap-fitted above the flame distributor, and the top plate has a plurality of fire holes; and the first through-holes are arranged adjacent to the top plate.

According to another aspect of the present application, an embodiment of the present application provides a water heater which comprises the above-mentioned burner.

Embodiments of the burner of the present application is installed integrally, which makes operation easy and is fixed securely, and also increases combustion intensity, reduces nitrogen oxide emissions, and ensures its safety during use.

The above summary is only for the purpose of description and is not intended to limiting in any way. In addition to the illustrative aspects, implementations, and features described above, further aspects, implementations, and features of the present application will become readily apparent by reference to the drawings and the following detailed description.

DETAILED DESCRIPTION OF THE DISCLOSURE

In the following, only certain exemplary embodiments are briefly described. The described embodiments may be modified in various different ways without departing from the spirit or scope of the present application. Accordingly, the drawings and description are to be regarded as illustrative in nature and not as restrictive.

In the first aspect of the present application, a burner is provided.

The burner of the present application is described below with reference to FIGS. 1-3.

Figure 1:
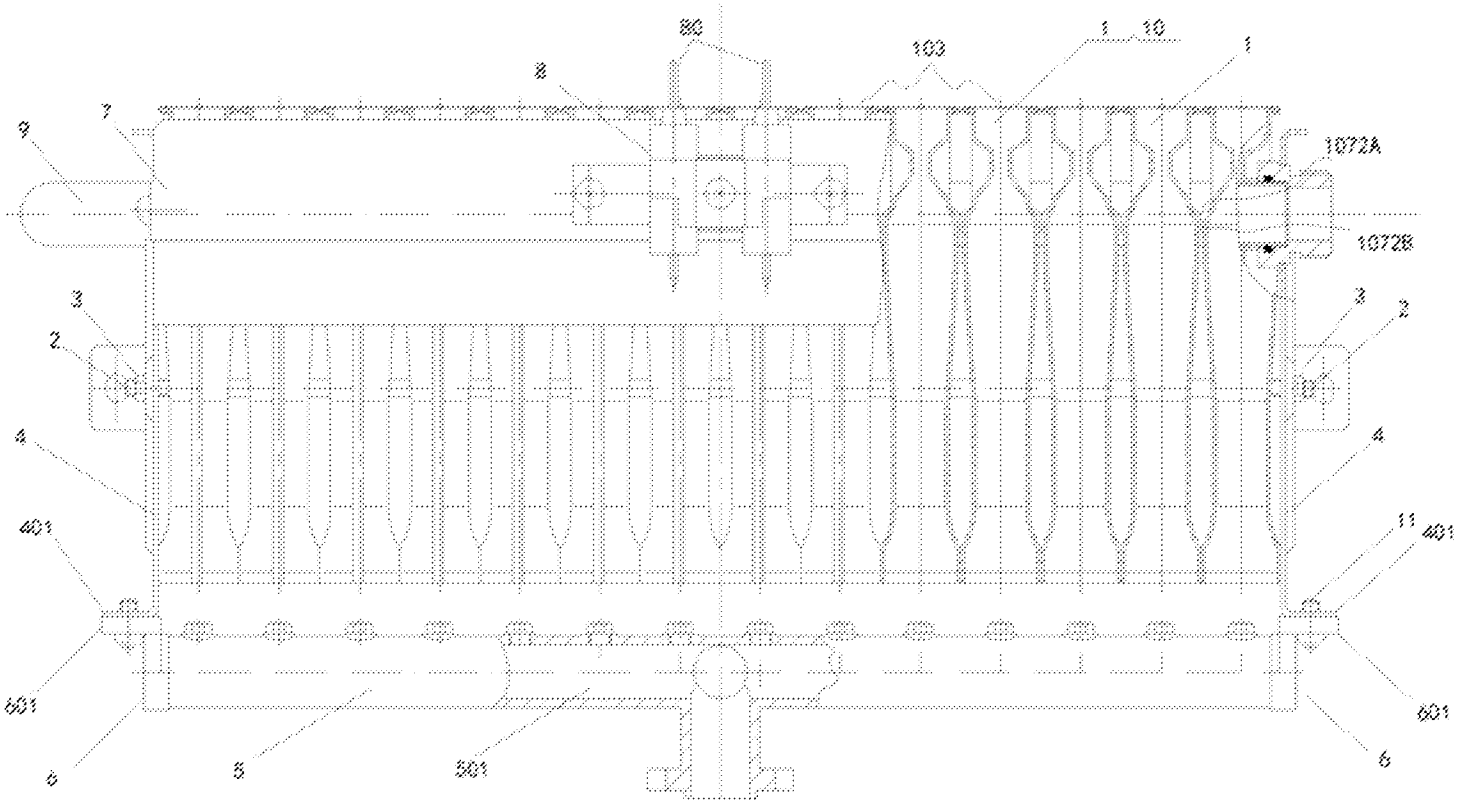
FIG. 1 is a front view of a burner according to an embodiment of the present application.

Referring to FIG. 1, in an embodiment, the burner of the present application comprises a plurality of flame distributors 1 that are arranged in parallel with each other. In combination with reference to FIG. 4, at least three ejection tubes 101 are provided on each flame distributor 1, and the flame distributor 1 of this embodiment is further provided with a gas mixing cavity 102. In one embodiment, a plurality of ejection tubes 101 are independent of each other, and each ejection tube 101 is in communication with the air mixing cavity 102. A plurality of ejection tubes 101 can eject a larger amount of gas, increasing the combustion intensity, reducing nitrogen oxides emissions, and ensuring its safety during use.

Furthermore, a fastener 2 can be used, passing through multiple flame distributors 1 to connect flame distributors 1 into a whole to form a fire grate 10. In this way, a plurality of independent flame distributors 1 can be connected into a whole through the connection by fastener 2 to achieve integral installation, and the connection by fastener 2 is easy to operate and such fixation is secure.

In one embodiment, both ends of fastener 2 may protrude relative to fire grate 10, i.e., fastener 2 has a protruding end. Also, a compacting piece 3 may be arranged at the protruding end of fastener 2, and it may compact fire grate 10, reducing the shaking of the flame distributors relative to each other and enhancing the stability of the connection among the plurality of flame distributors. In one embodiment, fastener 2 may be a bolt fastener, compacting piece 3 may be a nut, and the bolt may be locked by the nut after passing through the fire grate, but the selection and connection form of fastener 2 and compacting piece 3 are not limited thereto.

Figure 3:
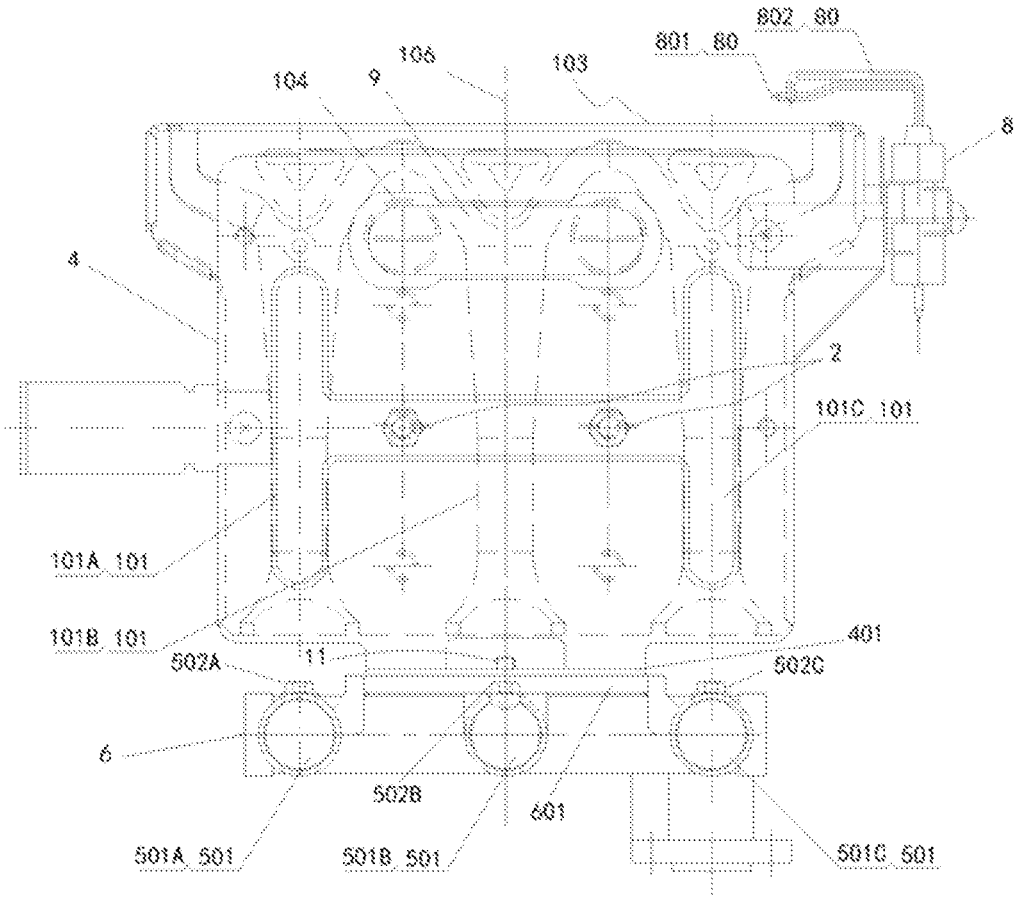
FIG. 3 is a right view of a burner according to an embodiment of the present application.

Referring to FIG. 3, in an embodiment, the fastener 2 may be in one pair, or in multiple pairs as desired. In one embodiment, each pair of fasteners 2 may be symmetrically arranged relative to the symmetry axis 106 of the flame distributors 1 in the plumb direction (in combination with reference to FIG. 4), whereby the stability of the connection is further ensured.

Referring to FIGS. 1 and 3, in an embodiment, a first side plate 4 is provided on either side of the fire grate 10. In one embodiment, both ends of the fastener 2 respectively pass through the corresponding first side plates 4, so that the first side plates 4 and the fire grate 10 may be connected into a whole. Also, both ends (protruding ends) of the fastener 2 may also protrude relative to the first side plates 4, so that the first side plate 4 and the fire grate 10 may be compacted by the compacting piece 3. Thus, after the first side plate 4 and the fire grate 10 are connected and fixed, the fire grate 10 can be simply connected to other components through the first side plate 4.

Referring to FIGS. 1 and 3, in an embodiment, the lower ends of the first side plates 4 respectively bend towards the outsides of the fire grate 10 and extend horizontally, forming first side platforms 401. In this way, the first side platform 401 may be used as a connection for connecting the fire grate 10 to other components, the specific manner of which will be described below.

Referring to FIGS. 1 and 3, in an embodiment, the burner further comprises a gas distribution device 5 for supplying gas to the flame distributors 1. Referring to FIG. 3, the gas distribution device 5 is arranged below the ejection tubes 101, the gas may enter into the ejection tubes 101 through the gas distribution device 5 and be injected and ejected to the top of the flame distributors 1 through the ejection tubes 101.

Furthermore, a plurality of gas passages 501 is provided in the gas distribution device 5, and the number and the distribution mode of the gas passages 501 should correspond to that of the ejection tubes 101. Also, the gas passage 501 may be in communication with the ejection tube 101 corresponding to its position.

Specifically, in an embodiment, the ejection tubes 101 comprises a first ejection tube 101A, a second ejection tube 101B, and a third ejection tube 101C. The gas distribution device 501 may comprise a first gas passage 501A, a second gas passage 501B, and a third gas passage 501C. The first gas passage 501A is in communication with the first ejection tube 101A corresponding to its position through a first nozzle 502A; the second gas passage 501B is in communication with the second ejection tube 101B corresponding to its position through a second nozzle 502B; the third gas passage 501C is in communication with the third ejection tube 101C corresponding to its position through a third nozzle 502C.

Furthermore, a second side plate 6 is provided at either side of the gas distribution device 5, and the second side plate 6 is securely connected to the gas distribution device 5, and the secure connection manner is not specifically defined here. The upper ends of the second side plates 6 respectively bend towards the outsides of the gas distribution device 5 and extend horizontally, forming second side platforms 601.

In one embodiment, the gas distribution device 5 and the fire grate 10 may be securely connected at the first side platforms 401 and the second side platforms 601. Specifically, in an embodiment, a bolt 11 or a screw may be used to pass through the first side platform 401 and the second side platform 601, and be locked by a nut at its protruding end, so that the gas distribution device 5 is securely connected to the fire grate 10. In one embodiment, the part used for secure connection is not limited to bolt or screw, and other parts for playing a fastening role may be used here; the part for locking is not limited to nut, and other parts for playing a locking role may be used here.

Figure 2:
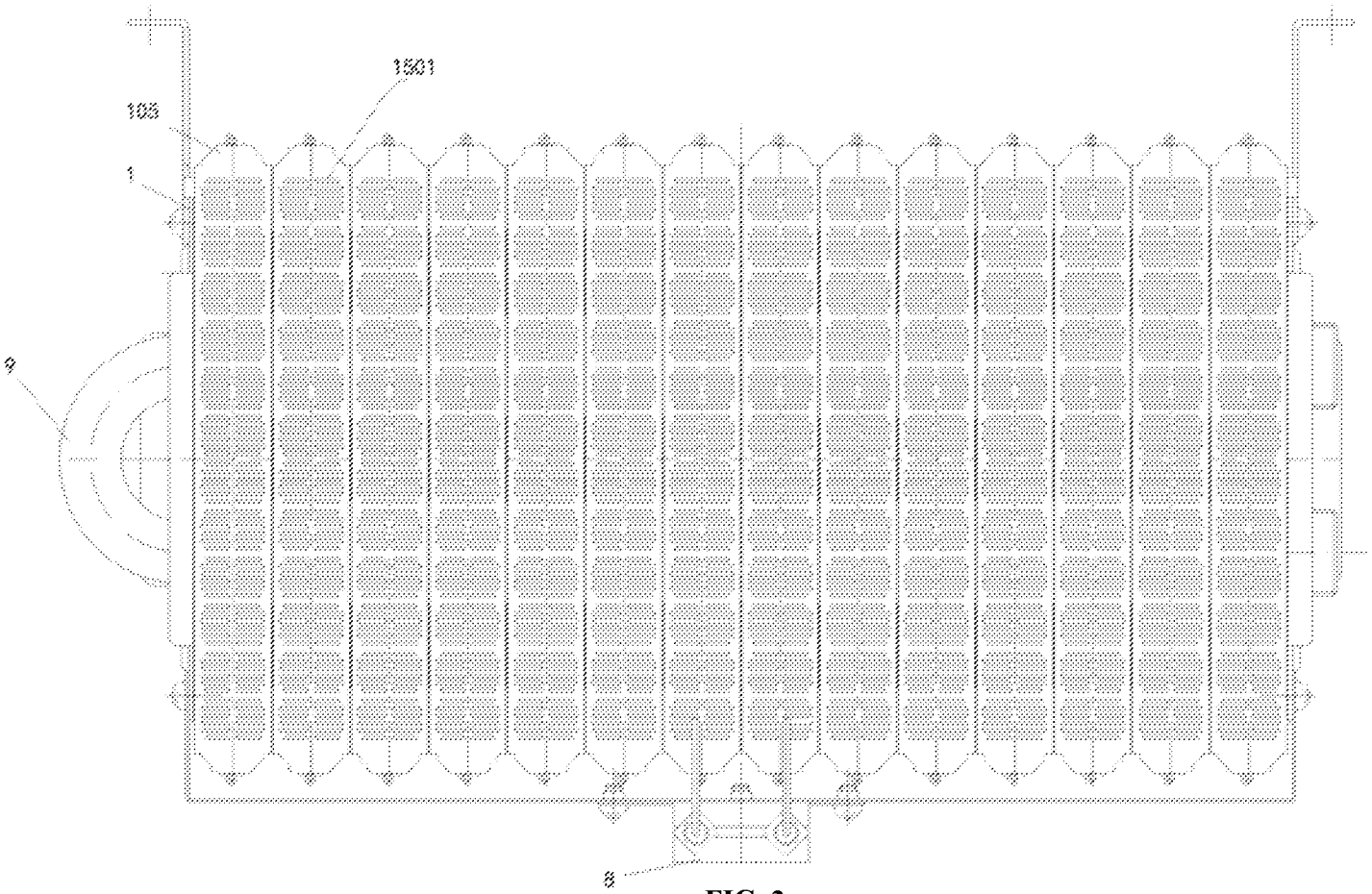
FIG. 2 is a top view of a burner according to an embodiment of the present application.

Referring to FIGS. 1-3, in an embodiment, a front side plate 7 is provided on the front side of the fire grate 10, and an igniter 8 is provided on the upper portion of the front side plate 7. An ignition portion 80 of the igniter 8 is arranged towards the gas outlet end 103 of the flame distributors 1. In this way, the gas ejected from the gas outlet end 103 of the flame distributors 1 may be ignited by the ignition portion 80, achieving combustion.

Furthermore, referring to FIG. 3, in an embodiment, the ignition portion 80 comprises a first ignition end 801 and a second ignition end 802.

In combination with reference to FIG. 1, based on the orientations shown in FIG. 1, and the first ignition end 801 protrudes towards the top of the front side plate 7, and then bends and continues to extend towards the rear of the front side plate 7. In this way, the first ignition end 801 is located above the gas outlet end 103, and the gas ejected from the gas outlet end 103 may be ignited in a larger range, improving the gas utilization rate.

The second ignition end 802 protrudes towards the top of the front side plate 7, and then bends and extends towards the rear of the front side plate 7, with its extending tip bent towards the gas outlet end 103, that is, bent downward. In this way, the second ignition end 802 is arranged towards the gas outlet end 103, and the gas may be ignited in time when the gas is ejected from the gas outlet end 103, increasing the combustion intensity.

Referring to FIGS. 1-3, in an embodiment, the burner further comprises a cooling water pipe 9, and the cooling water pipe 9 may be U-shaped.

During the long-time combustion of the burner, the fire grate would turn red, its temperature would increase, and nitrogen oxides would also be generated. In combination with reference to FIG. 4, the flame distributor 1 is provided with at least two first through-holes 104, and both ends of the cooling water pipe 9 respectively pass through the corresponding first through-holes 104 and pass throughout the fire grate 10. In this way, the cooling water pipe 9 may be in close contact with the flame distributors 1, lowering the temperature of the flame distributors 1 (fire grate 10), and further reducing the generated nitrogen oxides.

Furthermore, the first through-holes 104 are arranged between adjacent ejection tubes 101. In this way, each ejection tube 101 (the first ejection tube 101A, the second ejection tube 101B, and the third ejection tube 101C) may be adjacent to the cooling water pipe 9, and thus cooled by the cooling liquid in the cooling water pipe 9. Thereby, the temperature of the gas in each ejection tube 101 may be lowered, enabling the temperature of the gas lower when it is ejected from the gas outlet end 103, and thus further reducing the generated nitrogen oxides and also lowering the nitrogen oxides emissions.

Figure 4:
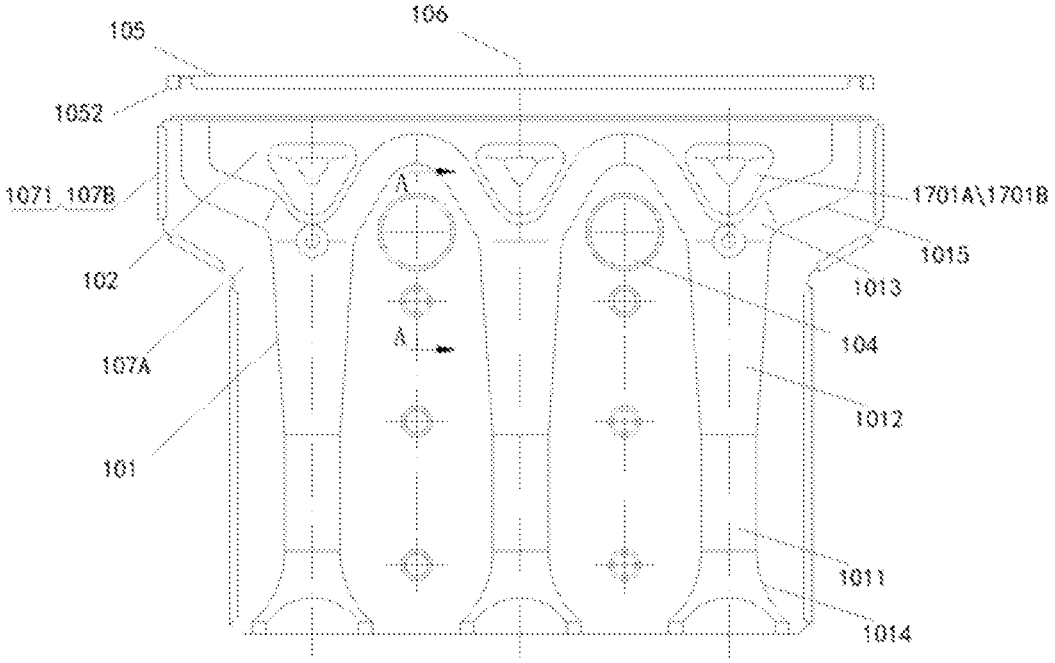
FIG. 4 is a front view of a flame distributor according to an embodiment of the present application.

Referring to FIG. 4, in an embodiment, a top plate 105 is snap-fitted above the flame distributor 1. Furthermore, in combination with reference to FIG. 5, the top plate 105 has a plurality of fire holes 1051, and the fire holes 1051 may be in communication with the gas outlet end 103, so that the gas ejected from the gas outlet end 103 may be output outwards through the fire holes 1051.

Figure 5:
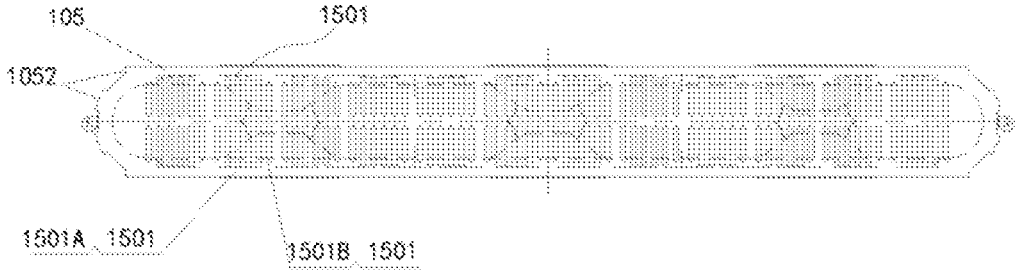
FIG. 5 is a top view of a flame distributor according to an embodiment of the present application.

Referring to FIG. 5, the fire holes 1051 may be irregularly arranged on the top plate 105, and the length of the fire holes 1051 are not exactly the same to each other, including a first fire hole 1051A having a longer length and a second fire hole 1051B having a shorter length. In one embodiment, the second fire hole 1051B having a shorter length outputs a smaller gas flow, therefore, when the gas is ignited by the igniter 8, the height of the flame generated there is thus lower, and the temperature of the flame is also lower.

In one embodiment, the first through-holes 104 are arranged adjacent to the top plate 105, so that the cooling water pipe 9 may bring better cooling effect to the top plate 105, and thus the gas temperature at the gas output location is further reduced, further reducing the generated nitrogen oxides.

Figure 6:
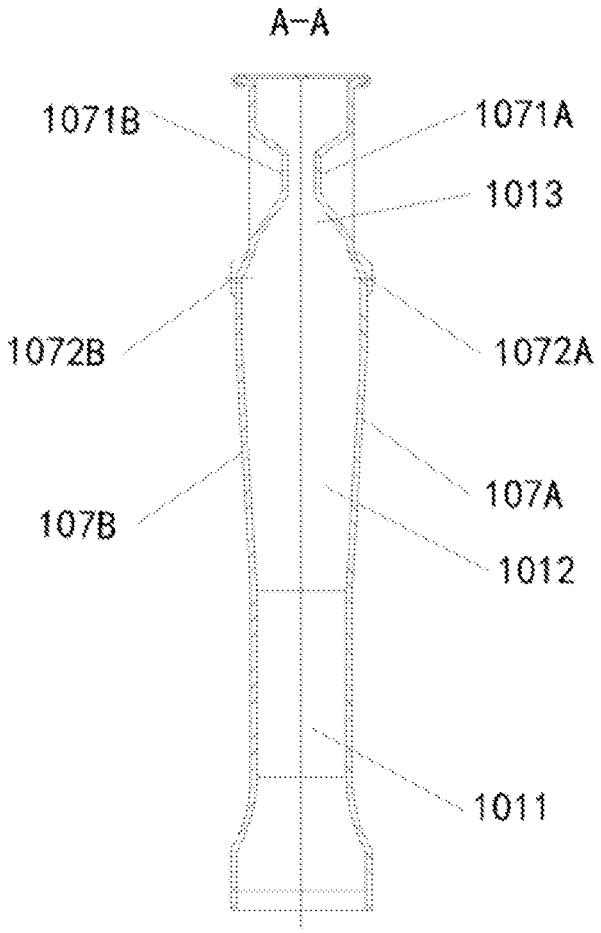
FIG. 6 is a cross-sectional view taken along line A-A in FIG. 4.

Referring to FIGS. 4-6, in an embodiment, the flame distributor 1 comprises a first housing 107A and a second housing 107B that are forward-backward symmetrically arranged, that is, the ejection tube 101 is formed by the first housing 107A and the second housing 107B, and the cavity of the ejection tube 101 is enclosed and formed by the first housing 107A and the second housing 107B. Also, the air mixing cavity 102 is enclosed and formed by the first housing 107A and the second housing 107B. In one embodiment, the second housing 107B is provided with an edge covering 1071 at its edge, and after the second housing 107B is snap-fitted to the first housing 107A, the edge covering 1071 is pressed onto the surface of the first housing 107A, the first housing 107 A and the second housing 107 B are securely riveted at the edge covering 1071, with more secure fixation and better sealing effect.

Furthermore, the top plate 105 is provided with a downward extending flange 1052 at its edge, and when the top plate 105 is snap-fitted to the flame distributor 1, the flange 1052 is lapped outside the first housing 107A and the second housing 107B and surrounds them, so that the top plate 105 and the first housing 107A and the second housing 107B may be sealingly secured, and therefore, the heat generated by the cooling water pipe 9 may be kept between the top plate 105 and the flame distributor 1 without flowing outwards, and then, the cooling effect on the flame distributor 1 may be enhanced.

Referring to FIGS. 4 and 6, in an embodiment, the ejection tube 101 may be divided into a negative pressure section 1011, a pressure expansion section 1012, and a gas mixing section 1013 from bottom to top.

In one embodiment, the gas enters into the ejection tube 101 from the negative pressure section 1011, and then passes through the pressure expansion section 1012 and the gas mixing section 1013. The negative pressure section 1011 is provided with an outwardly curved arc-shaped flow guiding face 1014 at its lower end. When the gas enters into the ejection tube 101, the arc-shaped flow guiding face 1014 may reduce the collision between the gas and the inner wall of the ejection tube 101, allowing the gas to flow smoothly in the ejection tube 101.

The gas mixing section 1013 is in communication with the pressure expansion section 1012, and the gas mixing sections 1013 of adjacent ejection tubes 101 are in communication with each other, forming a gas mixing cavity 102 to help uniformly mix the gas therein. The end faces of the gas mixing cavity 102 are inclined towards either side to form flow guiding slopes 1015, guiding the gas ejected from the mixer 102 to either side, to reduce the injection pressure of the gas.

In one embodiment, the surfaces of the first housing 107A and the second housing 107B at the position of the air mixing cavity 102 are respectively recessed towards the inside of the ejection tube 101, and correspondingly form a first concave portion 1071A and a second concave portion 1071B. In one embodiment, the first concave portion 1071A and the second concave portion 1071B may depress the gas flow, uniformly mixing the gas.

In one embodiment, the first concave portion 1071A and the second concave portion 1071B are in the shape of triangles, and the vertex angle thereof are on the axis of the ejection tube 101, and the angular value of the vertex angle may be between 35°~70°. Thereby, the first concave portion 1071A and the second concave portion 1071B may sufficiently break up the gas in the gas mixing cavity 102, reducing the gas flow resistance, and thus the gas may be fully ejected outward, improving the combustion intensity.

In one embodiment, the surfaces of the first housing 107A and the second housing 107B at the top position of the pressure expansion section 1012 respectively protrude towards the outside of the ejection tube 101, and correspondingly form a first protrusion portion 1072A and a second protrusion portion 1072B. In combination with reference to FIG. 1, when arranging the flame distributors 1, two adjacent flame distributors 1 may be positioned by and tightened against the first protrusion portion 1072A and the second protrusion portion 1072B, so that the plurality of flame distributors 1 would not shake upon secured.

In the second aspect of the present application, a water heater is provided.

In the description of the present application, reference to the term "one embodiment," "some embodiments," "an example," "a specific example," or "some examples" or the like means that the specific features, structures, materials or characteristics described in combination with the embodiment(s) or example(s) are included in at least one embodiment or example of the present application. Moreover, the particular features, structures, materials or characteristics described may be combined in any suitable manner in any one or more embodiments or examples.

Moreover, the terms such as "first" and "second" are used only for the purpose of description and cannot be understood as indicating or implying relative importance or implicitly indicating the number of features indicated. Therefore, the feature defined by "first" or "second" may explicitly or implicitly include at least one of that feature. In the description of the present application, "a plurality of" means two or more, unless otherwise specifically defined.

What is claimed is:

1. A burner, comprises:

a plurality of flame distributors each provided with at least three ejection tubes and arranged in parallel with each other;

a fastener passing through the plurality of the flame distributors and connecting the plurality of the flame distributors into a fire grate;

a compacting piece provided at a protruding end of the fastener relative to the fire grate and compacting the fire grate; and a cooling water pipe of U-shaped;

wherein each of the plurality of flame distributors is provided with at least two first through-holes, and both ends of the cooling water pipe respectively pass through the corresponding first through-holes and throughout the fire grate;

wherein the at least two first through-holes are arranged between the adjacent ejection tubes.

2. The burner according to claim 1, wherein the fastener comprises at least one pair of fasteners, each pair of fasteners are symmetrically arranged relative to a symmetry axis of the flame distributors in a plumb direction.

3. The burner according to claim 2, wherein a first side plate is provided on either side of the fire grate, both ends of the fastener respectively pass through their corresponding first side plates, and the first side plates and the fire grate are compacted by the compacting piece.

4. The burner according to claim 3, wherein lower ends of the first side plates respectively bend towards outsides of the fire grate and extend horizontally, forming first side platforms.

5. The burner according to claim 4, further comprises a gas distribution device arranged below the ejection tubes;

a plurality of gas passages are provided in the gas distribution device and the gas passages are in communication with the ejection tubes corresponding to their positions;

a second side plate is provided on either side of the gas distribution device, and upper ends of the second side plates respectively bend towards outsides of the gas distribution device and extend horizontally, forming second side platforms; and the gas distribution device is securely connected to the fire grate at the first side platforms and the second side platforms.

6. The burner according to claim 1, wherein a front side plate is provided on a front side of the fire grate, an igniter is provided on an upper portion of the front side plate, and an ignition portion of the igniter is arranged towards a gas outlet end of the flame distributors.

7. The burner according to claim 6, wherein the ignition portion comprises a first ignition end and a second ignition end;

the first ignition end protrudes towards top of the front side plate, and bends and extends towards rear of the front side plate; and the second ignition end protrudes towards the top of the front side plate, and bends and extends towards the rear of the front side plate, with its extending tip bent towards the gas outlet end.

8. The burner according to claim 1, wherein a top plate is snap-fitted above each of the plurality of flame distributors, and the top plate has a plurality of fire holes; and the first through-holes are arranged adjacent to the top plate.

9. A water heater, comprising a burner, wherein the burner comprises:

a plurality of flame distributors each provided with at least three ejection tubes and arranged in parallel with each other;

a fastener passing through the plurality of the flame distributors and connecting the plurality of the flame distributors into a fire grate;

a compacting piece provided at a protruding end of the fastener relative to the fire grate and compacting the fire grate; and a cooling water pipe of U-shaped;

wherein each of the plurality of flame distributors is provided with at least two first through-holes, and both ends of the cooling water pipe respectively pass through the corresponding first through-holes and throughout the fire grate;

wherein the at least two first through-holes are arranged between the adjacent ejection tubes.

10. The burner according to claim 2, wherein a front side plate is provided on a front side of the fire grate, an igniter is provided on an upper portion of the front side plate, and an ignition portion of the igniter is arranged towards a gas outlet end of the flame distributors.

11. The water heater according to claim 10, wherein a first side plate is provided on either side of the fire grate, both ends of the fastener respectively pass through their corresponding first side plates, and the first side plates and the fire grate are compacted by the compacting piece.

12. The water heater according to claim 11, wherein lower ends of the first side plates respectively bend towards outsides of the fire grate and extend horizontally, forming first side platforms.

13. The water heater according to claim 12, wherein the burner further comprises a gas distribution device arranged below the ejection tubes;

a plurality of gas passages are provided in the gas distribution device and the gas passages are in communication with the ejection tubes corresponding to their positions;

a second side plate is provided on either side of the gas distribution device, and upper ends of the second side plates respectively bend towards outsides of the gas distribution device and extend horizontally, forming second side platforms; and the gas distribution device is securely connected to the fire grate at the first side platforms and the second side platforms.

14. The water heater according to claim 10, wherein the ignition portion comprises a first ignition end and a second ignition end;

the first ignition end protrudes towards top of the front side plate, and bends and extends towards rear of the front side plate; and the second ignition end protrudes towards the top of the front side plate, and bends and extends towards the rear of the front side plate, with its extending tip bent towards the gas outlet end.

15. The water heater according to claim 9, wherein a top plate is snap-fitted above each of the plurality of flame distributors, and the top plate has a plurality of fire holes; and the first through-holes are arranged adjacent to the top plate.

* * * * *